United States Patent [19]

Martin et al.

[11] 4,127,706

[45] Nov. 28, 1978

[54] POROUS FLUOROPOLYMERIC FIBROUS SHEET AND METHOD OF MANUFACTURE

[75] Inventors: Graham E. Martin; Ian D. Cockshott; Kevin T. McAloon, all of Runcorn, England

[73] Assignee: Imperial Chemical Industries Limited, London, England

[21] Appl. No.: 617,529

[22] Filed: Sep. 29, 1975

[30] Foreign Application Priority Data

Sep. 26, 1974 [GB] United Kingdom ..... 41873/74

[51] Int. Cl.[2] ..... B22D 23/08; B29D 27/00

[52] U.S. Cl. ..... 429/122; 264/10; 264/22; 264/127; 264/205; 264/DIG. 75; 428/357; 429/254

[58] Field of Search ..... 264/DIG. 75, 205, 10, 264/22, 26, 127; 428/357; 429/122, 254

[56] References Cited

U.S. PATENT DOCUMENTS

| | | | |
|---|---|---|---|
| 2,336,743 | 12/1943 | Manning | 264/DIG. 75 |
| 2,336,745 | 12/1943 | Manning | 264/DIG. 75 |
| 2,718,452 | 9/1955 | Lontz | 264/205 |
| 2,810,426 | 10/1957 | Till et al. | 264/DIG. 75 |
| 2,867,495 | 1/1959 | Myers | 264/205 |
| 2,988,469 | 6/1961 | Watson | 264/DIG. 75 |
| 3,227,664 | 1/1966 | Blades et al. | 264/205 |
| 3,725,518 | 4/1973 | Gaffney | 264/24 |
| 3,875,270 | 4/1975 | Haefner et al. | 264/13 |
| 3,914,354 | 10/1975 | Ueki et al. | 264/13 |
| 3,933,557 | 1/1976 | Pall | 264/DIG. 75 |
| 3,994,258 | 11/1976 | Simm | 264/10 |
| 4,043,331 | 8/1977 | Martin et al. | 128/156 |
| 4,044,404 | 8/1977 | Martin et al. | 128/156 |

FOREIGN PATENT DOCUMENTS

| | | | |
|---|---|---|---|
| 43-553 | 1/1968 | Japan | 264/176 F |
| 1,346,231 | 2/1974 | United Kingdom | 264/10 |

*Primary Examiner*—Jay H. Woo

*Attorney, Agent, or Firm*—Cushman, Darby, & Cushman

[57] ABSTRACT

A method of preparing a porous sheet product which comprises the step of introducing a spinning liquid comprising an organic fibre forming polymeric material into an electric field whereby fibres are drawn from the liquid to an electrode and collecting the fibres so produced upon the electrode. PTFE and other fluorinated polymer mats produced by the electrostatic process are useful as electrolytic cell diaphragms, battery separators etc.

17 Claims, 4 Drawing Figures

POROUS FLUOROPOLYMERIC FIBROUS SHEET AND METHOD OF MANUFACTURE

Figure 1:
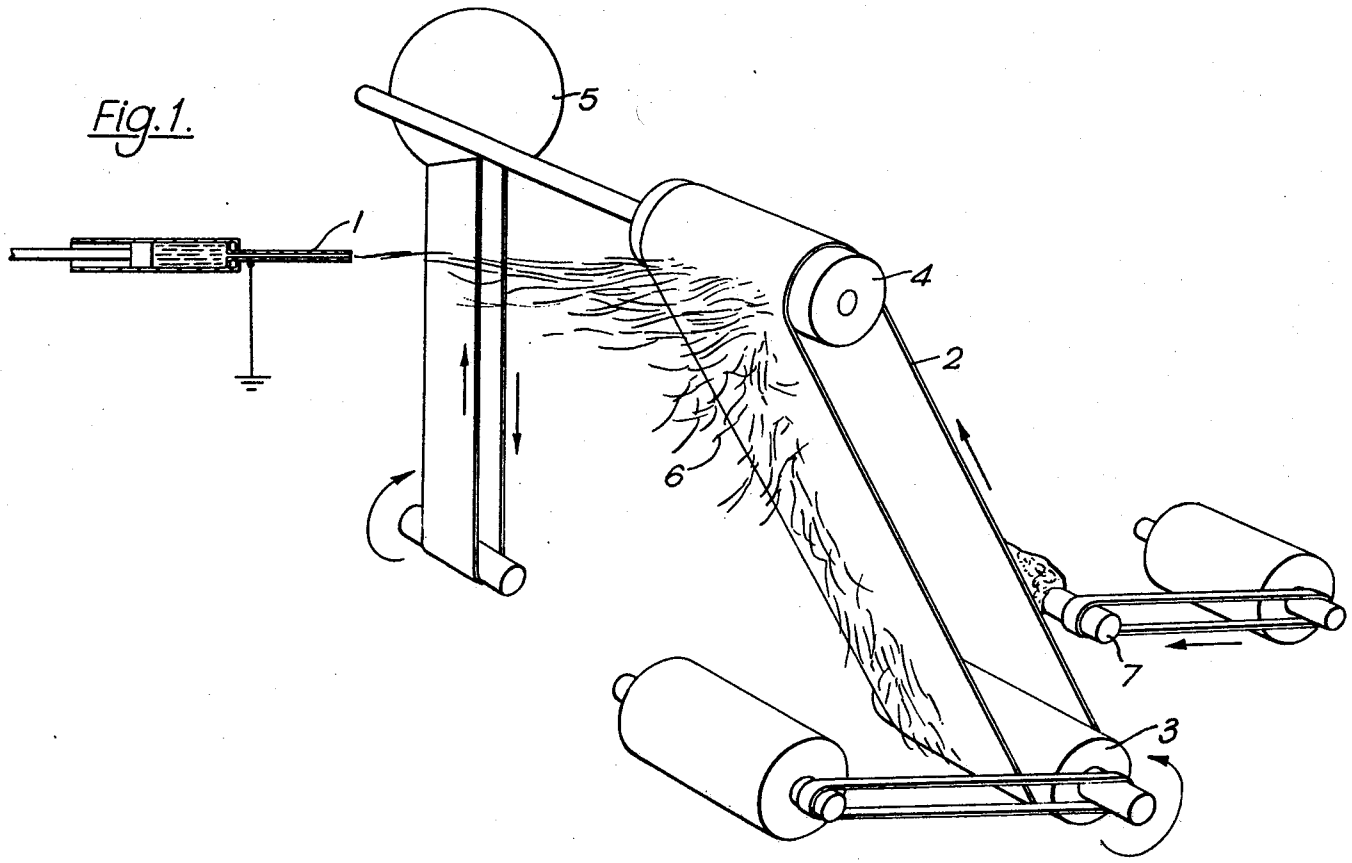

This invention relates to porous products and particularly to porous sheet products and to the preparation and uses therefor.

Porous sheet products are used in many locations in which the material of which the product is made needs to be inert to chemicals with which it comes into contact. 'Inert' as used herein means that the product is sufficiently inert to the environment to which it will be exposed during use to enable it to have a functional life. Typical examples of such products are electrolytic cell diaphragms, battery separators, fuel cell components, dialysis membranes and the like. Where the material of which they are made imparts the appropriate properties they may also be employed, say, to separate wetting from non-wetting fluids. Fluorinated polymers, and particularly polytetrafluoroethylene (PTFE), have been suggested as being suitable for the preparation of sheet products, and methods of making porous electrolytic cell diaphragms have been described for example in British Pat. No. 1,081,046, and UK Patent Application No. 5351/72.

The invention provides a method of preparing a product comprising an inert material which method comprises subjecting a spinning liquid comprising the polymer to electrostatic spinning conditions.

The product of the invention will usually be in the form of a sheet or mat.

The process of electrostatic spinning involves the introduction of a suitable spinning liquid into an electric field whereby fibres are drawn from the liquid to an electrode. While being drawn from the liquid the fibres harden, which may involve mere cooling (where the liquid is normally solid at room temperature, for example, and is melted to enable spinning to take place), chemical hardening (for example by treatment with a hardening vapour or by cross-linking) or by evaporation of solvent (for example by dehydration). The resulting fibres may be collected on a suitably located receiver and subsequently stripped from it conveniently in the form of a sheet or mat. Any of these techniques may be employed in the process of the invention, the selection of an appropriate technique depending inter alia, upon the polymer being spun. The fibres produced by the electrostatic spinning process are thin, usually of the order of 0.1 to 25 micron, preferably 0.5 to 10 micron, and more preferably 1 to 5 micron in diameter, and the process enables considerable control to be exercised, based largely upon experience, upon fibre diameter. The porosity of a sheet of fibres produced by this method depends to some extent upon the fibre diameter and some control of pore size can be exercised by selection of appropriate fibre diameter. For a given sheet density fibres of small diameter tend to give products having small pores, while those of greater diameter give larger pores. Preferred products have a pore size such that at least 80% of the pores are less than 5 $\mu$ in diameter. Our preferred inert polymeric material for use according to the invention is a fluorinated polymer and as examples of such polymers we may mention polyvinyl fluoride, polyvinylidene fluoride, polychlorotrifluoroethylene, fluorinated ethylene/propylene copolymers, perfluoroalkoxy compounds and fluorinated ethylene/perfluorovinyl ether copolymers. The preferred polymer is polytetrafluoroethylene. For convenience fluorinated polymer in general will be referred to hereinafter as PTFE, the name polytetrafluoroethylene being used when this particular polymer is specifically referred to.

Although the invention will be decided with particular reference to PTFE it will be appreciated that the technique may be applicable to a wide range of inert materials and the use of the description PTFE does not exclude such other suitable materials.

The spinning liquid should contain the PTFE in such quantity that it is capable of forming a fibre and it should have cohesive properties such that the fibre form is retained during any post-fibreization treatment, for example hardening, until the fibre has hardened sufficiently not to lose its fibrous shape on detachment from a support.

The spinning liquid preferably comprises a suspension of PTFE is a suitable suspending medium; conveniently the spinning liquid comprises also an additional component which acts to enhance the viscosity of the spinning liquid and to improve its fibre-forming properties. Most convenient for this purpose, we have found, is an organic polymeric material which subsequent to fibre formation can, if desired, be destroyed for example by sintering.

Where mats are spun from dispersion they often have a tendency to be friable, being mere agglomerations of discrete particles held together in the form of fibres by the additional organic polymeric component present. Preferably, therefore, such mats are sintered so that the particles soften and flow into each other, and the fibres may become point bonded without destroying the porous nature of the product. In the case of PTFE, sintering may conveniently be carried out between 330° C and 450° C, preferably between 370° C and 390° C. The sintering temperature preferably is sufficiently high to destroy completely any undesirable organic component in the final product e.g. material added solely to enhance viscosity or emulsifying agent.

The additional polymeric component need be employed only in a relatively small proportion (usually within the range 0.0001 to 12% preferably 0.01 to 8% and more preferably 0.1 - 4%) by weight of the spinning liquid, although the precise concentration for any particular application can easily be determined by trial.

The degree of polymerisation of the additional polymeric component is preferably greater than about 2000 units linearly, a wide range of such polymers is available. An important requirement is solubility of the polymer in the selected solvent or suspending medium, which is preferably water. As examples of water-soluble polymeric compounds for this purpose we may mention polyethylene oxide, polyacrylamide, polyvinyl pyrrolidone and polyvinyl alcohol. Where an organic liquid is employed to prepare the spinning liquid, either as a sole liquid or as a component thereof, a further wide range of additional polymeric components is available, for example polystyrene and polymethylmethacrylate.

The degree of polymerisation of the additional polymeric component will be selected in the light of required solubility and the ability of the polymer to impart the desired properties of cohesion and viscosity to the spinning liquid.

We have found that generally the viscosity of the spinning liquid whether due solely to the presence of the PTFE or partly contributed to by the additional polymeric component or other ingredients, should be greater than 0.1 but not greater than 150 poise. Preferably it is between 0.5 to 50 poise and more preferably between 1 and 10 poise (viscosities being measured at low shear rates). The viscosity required, using a given additional polymeric component (APC), will usually vary with the molecular weight of the APC, i.e. the lower the molecular weight of the APC the higher the final viscosity needed. Again, as the molecular weight of the APC is increased a lower concentration of it is required to give good fibreization. Thus, as examples we would mention that we have found that using a polyethylene oxide of MW 100,000 as APC a concentration of about 12% by weight relative to the PTFE content is needed to give satisfactory fibreization, whereas with a MW of 300,000 a concentration of 1 to 6% may be adequate. Again, at a MW of 600,000 a concentration of 0.5 to 4% is satisfactory, while at a MW of $4 \times 10^6$ a concentration as low as 0.2% may give good fibreization.

The effect upon fibre diameter of varying the molecular weight and concentration of an APC (polyethylene oxide) in a spinning liquid containing an aqueous dispersion of PTFE of number average median particule size 0.22 microns (the Standard Specific Gravity of the polymer by ASTM test D 792–50 being 2.190) containing 3.6% by weight, based on the weight of the dispersion, of surfactant "Triton" X100 (Rohm and Haas) and having a PTFE solids content of 60% by weight is illustrated in the table below,

| Mn | Conc.$^n$ (wt.% of total liquid) | diameter of sintered fibres |
|---|---|---|
| $2 \times 10^5$ | 4 | 1.0 – 1.6 μ m |
| $3 \times 10^5$ | 2 | 1.0 – 2.0 μ m |
| $4 \times 10^5$ | 2 | 1.2 – 2.8 μ m |
| $6 \times 10^5$ | 1 | 1.5 – 4.0 μ m |
| $4 \times 10^6$ | 0.2 | 1.5 – 4.5 μ m |

Increasing the concentration of a given molecular weight APC does tend to broaden the fibre diameter range, but this is not usually undesirably excessive, particularly with lower mw APC. However, the concentration of APC may markedly affect the morphology of the fibres obtained; the effect resulting from any particular combination of components and concentrations can be determined by simple trial APC's other than polyethylene oxide e.g. polyvinyl alcohol (PVA) and polyvinyl pyrrolidone (PVP) may require the use of other concentrations, but the optimum can easily be determined for any given combination of components. For example with the above mentioned APC's we have found that concentrations greater than 6% w/w are required to give fibres which average between 0.5 and 1 micron in diameter. Selection of the APC will be made with regard to its effect upon the properties of the final product, including colouration which may follow any sintering process which may be employed. Both PVA and PVP, we find, tend to give weaker products and also strong colouration after sintering compared with polyethylene oxide.

The concentration of the PTFE will depend upon the amount required to provide adequate fibre properties, and will be influenced also by the need to produce a liquid of appropriate viscosity and speed of fibre hardening. Thus we may use a concentration within the range 25% w/w to saturation, (in the case of a dispersion, 'saturation' means the maximum concentration which may be included without destroying the useful spinnability of the liquid) preferably 40 to 70% and more preferably 50 to 60%.

It will be appreciated that the concentration of each of the components must be adjusted to take account of the presence and concentration of any other and their relative effects upon viscosity, etc.

The spinning material should have some electrical conductivity, although this may vary between quite wide limits, for example we prefer to employ solutions having conductivity within the range $1 \times 10^{-6}$ to $5 \times 10^{-2}$ siemens $cm^{-1}$.

The incorporation of a small quantity of an electrolyte in the spinning material can be used to increase its conductivity. Thus, we find that the presence of a very small amount (0.2 –3%, usually 1%) by weight of a salt, for example an inorganic salt e.g. KCl, added to a PTFE spinning dispersion increases the conductivity considerably (1% causes an increase from $1.8 \times 10^{-4}$ to $1.2 \times 10^{-2}$ siemens $cm^{-1}$).

Dispersions having high conductivities tend to produce finer fibres than do less conducting compositions. For example a dispersion having a conductivity of $1.8 \times 10^{-4}$ siemens $cm^{-1}$ gave, under certain conditions, fibres of diameters 2 to 3 microns whereas under the same conditions the same composition with the addition of 1% w/w KCl gave fibres of only 0.5 to b 1.5 micron in diameter. We found also that the fibres spread out over a wider and more even band on the collector, although the total rate of production of fibre dropped somewhat.

Obviously the electrolyte selected for addition to the spinning liquid will be one which will have no adverse effect upon the product, either as a consequence of its presence in the composition or the final product, a wide range of salts capable of incresing conductivity are known.

Any convient method may be employed to bring the spinning liquid into the electrostatic field, for example we have supplied the spinning liquid to an appropriate position in the electrostatic field by feeding it to a nozzle from which it is drawn by the field, whereupon fibreization occurs. Any suitable apparatus can be employed for this purpose; thus for example we have fed the spinning liquid from a syringe reservoir to the tip of an earthed syringe needle, the tip being located at an appropriate distance from an electrostatically charged surface. Upon leaving the needle the fibres form between the needle tip and the charged surface.

Droplets of the spinning liquid may be introduced into the field in other ways which will be apparent to the skilled man, the only requirement being that they can be held within the field at a distance from the electrostatically charged surface such that fibreization occurs. For example they could be carried into the field on, say, a continuous carrier, e.g. a metal wire.

It will be appreciated that where the spinning liquid is fed into the field through a nozzle, several nozzles may be used to increase the rate of fibre production. Alternative means of bringing the spinning liquid into the charge field may be employed, for example a perforated plate (the perforations being fed with spinning liquid from a manifold) may be employed.

In one embodiment which will be described for purposes of illustration only, the surface to which the fibres are drawn is a continuous surface, as of a drum, over which passes a belt which may be withdrawn from the region of charge, carrying with it the fibres which have been formed and which have become attached thereto.

Such an arrangement is shown in the attached drawings in which FIG. 1 is a diagrammatic side view of apparatus for the continuous production of fibres. In FIG. 1, 1 is an earthed metal syringe needle supplied from a reservoir with spinning liquid at a rate related to the rate of fibre production. Belt 2 is of gauze driven by a driving roller 3 and an idler roller 4 to which is fed an electrostatic charge from a generator 5 (in the apparatus illustrated a Van de Graaff machine). Removal of the fibre mat 6 from belt 1 is by any convenient means, for example by suction or by air jet, or it may be removed by juxtaposition of a second belt carrying sufficient electrostatic charge to effect detachment of the mat from belt 2. In the Figure the mat is shown being picked up by a roller 7 rotating against the belt.

The optimum distance of the nozzle from the charged surface is determined quite simply by trial and error. We have found, for example, that using a charged surface with potential of the order of 20 Kv a distance of 10–25 cm is suitable, but as the charge, nozzle dimensions, liquid flow rate, charged surface area etc. are varied so the optimum distance may vary, and it is most conveniently determined by simple trial.

Alternative methods of fibre collection which may be employed include the use of a large rotating cylindrical charged collecting surface substantially as described, but the fibres being collected from another point on the surface by a non-electrically conducting pick-up means instead of being carried away on the belt. In a further embodiment the electrostatically charged surface may be the sides of a rotating tube, the tube being disposed coaxially with the nozzle and at an appropriate axial distance from it. Alternatively deposition of fibres and the formation of a tube may occur on a tubuler or solid cylindrical former, with optionally subsequent removal of the mat from the former by any convenient means. The electrostatic potential employed will usually be within the range 5 Kv to 1000 Kv, conveniently 10–100 Kv and preferably 10–50 Kv. Any appropriate method of producing the desired potential may be employed. Thus, we illustrate the use of a conventional van de Graaff machine in FIG. 1 but other commercially available and more convenient devices are known and may be suitable.

It is, of course, desirable that the electrostatic charge is not conducted from the charged surface and where the charged surface is contacted with ancillary equipment, for example a fibre collecting belt, the belt should be made of a non-conducting material (although is must not, of course, inulate the charged plate from the spinning liqui). We have found it convenient to use as the belt a thin Terylene (RTM) net of mesh size 3mm. Obviously all supporting means, bearings etc. for the equipmeent will be insulated as appropriate. Such precautions will be obvious to the skilled man.

Fibres having different properties may be obtained by adjusting their composition either by spinning a liquid containing a plurality of components, each of which may contribute a desired characteristic to the finished product, or by simultaneously spinning from different liquid sources fibres of different composition which are simultaneously deposited to form a mat having an intimately intermingled mass of fibres of different material. A further alternative is to produce a mat having a plurality of layers of different fibres (or fibres of the same material but with different characteristics e.g. diameter) deposited, say, by varying with time the fibres being deposited upon the receiving surface. One way of effecting such variation, for example, would be to have a moving receiver passing in succession sets of spinnerets from which fibres are being electrostatically spun, said fibres being deposited in succession as the receiver reaches an appropriate location relative to the spinnerets.

To allow high production rates, hardening of the fibres should occur rapidly and where a solution is used as the spinning liquid this is facilitated by the use of concentration spinning liquid (so that the minimum of solvent or suspending liquid has to be removed), easily volatile liquids (for example the liquid may be wholly or partly of low boiling organic liquid) and relatively high temperatures in the vicinity of the fibre formation. The use of a gaseous, usually air, blast, particularly if the gas is warm, will often accelerate hardening of the fibre. Careful direction of the air blast may also be used to cause the fibres, after detachment, to lay in a desired position or direction. However, using conditions as described in the Examples no particular precautions were needed to ensure rapid hardening. The preferred spinning conditions in air, are a temperature above 25° C (more preferably 30° to 50° C) and a humidity lower than 40%.

After their formation the fibres may be sintered at a temperature sufficiently high to destroy any undesirable organic component in the final product, e.g. material added solely to enhance viscosity.

Sintering is often accompanied by shrinkage; up to 65% reduction in area has been observed in a sheet consisting of 100% polytetrafluoroethylene fibres.

It is important, therefore, that the product is free to move during sintering so that shrinkage may occur evenly (if so desired). We prefer to support the product, particularly if it is a flat sheet, in the horizontal position. Thus it may be supported upon a sheet of any material to which it does not stick, e.g. a fine gauze of stainless steel wire. However our preferred support is a bed of fine powder or particulate material which is stable at the sinter temperature. In particular we prefer to use as the support a bed comprising particles of a material the presence of which in the product will not be disadvantageous. For example, we have used a bed comprising titanium dioxide powder when preparing a wettable PTFE sheet, since the presence of any titanium dioxide powder retained in the sheet will not be disadvantageous.

For many applications it is desirable or even essential that the product be wettable by a liquid, usually polar, e.g. water. However polytetrafluoroethylene, for example, is not water wettable, and we have found it advantageous to incorporate in the product a material which imparts thereto a desired degree of water wettability.

According to another aspect of the invention, therefore, we provide a product obtained by the electrostatic spinning, the product comprising a normally slightly or non-wettable material, and said product comprising also a wettable additive, said wettable additive being capable of imparting a degree of wettability to the sheet product.

The wettable additive is preferably (although not necessarily) an inorganic material, conveniently a refractory material, and should have stability appropriate to the conditions of use. Thus, if the product is employed as an electrolytic cell diaphragm it is important that the wettable additive is chemically stable in the cell-liquor, that it is not leached too rapidly, if at all, from the diaphragm for it to be useful and that its presence does not affect the performance of the diaphragm disadvantageously. It is also obviously important that the presence of the wettable additive should not weaken the diaphragm to such an extent that handling or use is made unduly difficult or that dimensional stability is affected to an undesirable degree. The preferred wettable additive is an inorganic oxide or hydroxide, and examples of such materials are zirconium oxide, titanium oxide, chromic oxide, and the oxides and hydroxides of magnesium and calcium although any other suitable material or mixtures of such materials with those already mentioned may be employed.

The wettable additive may be incorporated in the spinning liquid either as such or as a precursor which may be converted by suitable treatment either during or after fibre spinning. The wettable additive may conveniently be present as a dispersed particulate material in suspension in the spinning liquid or alternatively it may be used in solution in the spinning material. For example we have successfully employed zirconium acetate as a dissolved component of the spinning liquid in appropriate concentration, the salt being converted to the oxide by sintering the mat.

It is sometimes found that, possibly because of absorption of one component of the spinning liquid upon another the use of dispersions of certain wettable additives does not give optimum results. In such circumstances we have found it advantageous to use coated particulate wettable additive (e.g. BTP 'Tioxide' grade RCR 2 or RTC 4) so that such adsorption is reduced. Alternatively the spinning liquid and a fibreizable solution or suspension of the wettable additive may be spun f4om different spinning points, conveniently in close proximity, to the same collector so that the resulting PTFE and additive fibres intermingle. (As an example, fibreizable zirconium acetate solutions may be prepared by dissolving the equivalent of 20 - 35% w/w, preferaly 25-32% w/w, zirconia in water to which is added high MW linear organic polymer as described above for the preparatin of the PTFE spinning liquid viscosity being adjusted to between 0.5 and 50, preferably 1 and 10, poise).

Where the wettable additive is incorporated as a precursor which is converted into the wettable additive by a post fibreization or post-impregnation treatment, the treatment employed should, of course, be one which is compatible with the production of a useful product and does not affect the properties of the product to an unacceptable degree. The choice of the wettable agent and its method of incorporation will be made in the light of this requirement.

Another method of incorporating the wettable additive, or a precursor, into the product is to apply it in solid powder from to the fibrous mat as it is being laid down upon the former. Conveniently this may be done by blowing the powder on to the mat in a stream of air.

Wettable additive may be incorporated into the product after its formation, for example by immersion or steeping of the product in a suspension of the additive or appropriate precursor in a suitable liquid, followed by draining of excess material. A method of imparting wettability has been described in British Patent Application No. 23316/74, in which a sheet product is contacted with, suitably by agitation in, a suspension of titanium dioxide in alcohol for several hours. Such a technique is equally applicable in thee present case.

Suitable proportions of the wettable additive in the final mat are 5% to 60% preferably 10% to 50% by weight although the skilled man wil have no difficulty in determining appropriate concentrations by a process of simple trial.

A further method of imparting water wettability to the product is to form hydrophilic groups on the polymeric component of the product, for example by (e.g. radiation) grafting of a suitable monomer or polymer.

The invention further provides a method of varying the porosity of a porous sheet product comprising PTFE by compressing a previously prepared porous sheet of the product to the desired porosity.

Compression is effected conveniently by placing the sheet of porous material between platens and applying pressure in an appropriate direction so that reduction of the thickness of the sheet occurs until the degree of porosity (determined by trial) is attained.

We have sometimes found it useful to heat the product during compression, and occasionally increased dimensional stability may be obtained by heating the product after compression.

Where wettable additive is to be incorporated into the product by immersion as hereinbefore described compression and (optionally) heating may preceed or follow said immersion and drying of the impregnated product.

The use of elevated temperatures during the compression step is advantageos in facilitating compression, reducing in some extent the pressure required to attain a desired degree of porosity. Conveniently the sheet is heated, during compression, to a temperature within the range 25° C to just below (e.g. about 25° C below) the softening point of the PTFE (for polytetrafluoroethylene preferably to between 100° C and 200° C).

Temperatures above the softening point of the PTFE may be employed, but not so high that complete collapse of the sheet occurs, with consequent complete loss of porosity, and it is desirable to control compression, whether carried out at temperatures above or below the softening point of the PTFE, so that complete collapse of the material is avoided unless this is specifically required.

The degree of compression will depend upon the intended use of the sheet, but we have found that a reduction in thickness to 30 to 80%, usually 40 to 65% of its newly spun thickness is often appropriate.

Shaping of the mat may also be effected during the compression step, for example by employing platens the faces of which comprise shaping means, e.g. raised and depressed regions whereby a contoured compressed sheet may be obtained or a sheet compressed in some areas and not, or less so, in others. In this way, for example, percolation of the electrolyte through different regions of a cell diaphragm may be controlled by preparing a diaphragm having lower porosity in some areas e.g. where hydrostatic pressure in the cell is higher. Some relaxation of the compressed product tends to occur gradually after compression, but this may be determined by simple experiment and appropriate conditions selected accordingly so that the relaxation is compensated for. By the application of post formation compression techniques it is possible to prepare sheet products having a degree of porosity suited to a particular end-use and some increase in the strength of the sheet compared with the uncompressed may may also be observed.

Sheet products made according to the invention find particular application as electrolytic cell diaphragms, since they may be highly chemically resistant. Although the following examples describe the production only of flat porous sheets, it will be appreciated that shaped diaphragms can readily be made e.g. by deposition of the fibres upon a suitably contoured charged mandrel from which they may be removed before or after sintering, depending upon the strength of the material and the degree of distortion tolerable in its removal. Dimensions of the sheet products will, of course, be governed by their intended use.

Alternatively the fibres could be spun on to an appropriately charged collector which is itself a cell cathode gauze.

Figure 2:
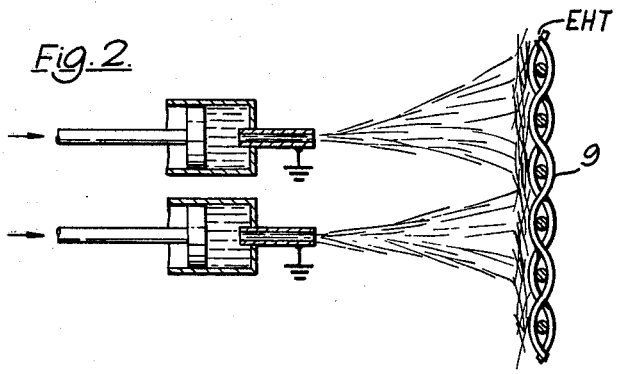
Figure 3:
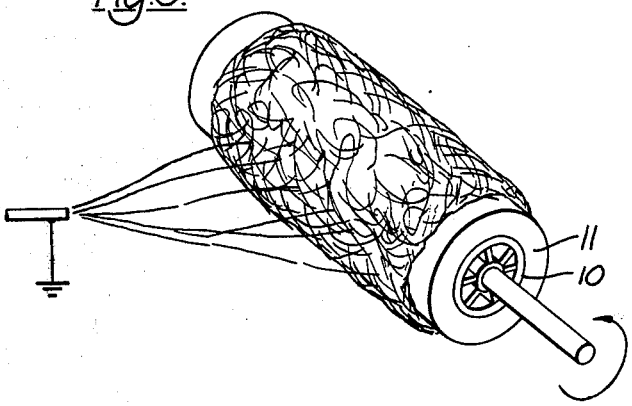

Alternative collectors are shown in FIGS. 2 and 3 in which 9 is a flat chrged wire mesh or grill and 11 is a porous polyurethane sleeve over a charged rotating metal core 10.

Figure 4:
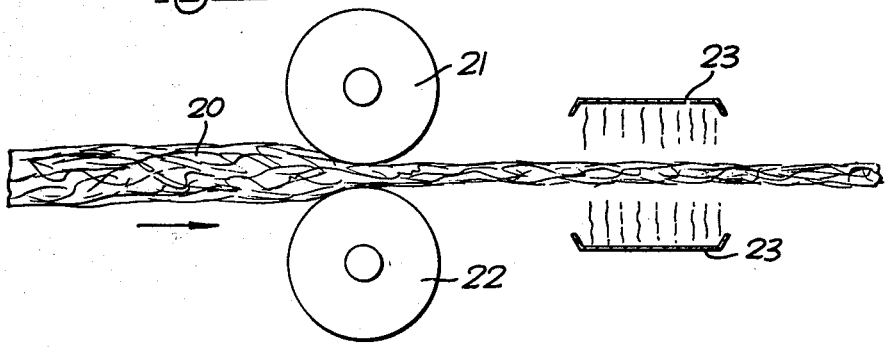

FIG. 4 shows diagrammatically, in side elevation, the compression of a PTFE fibre mat 20 to reduce its thickness by passing it between rollers 21 and 22, compression being followed by a heating step e.g. by radiant heaters 23. Diaphragms obtained by the process of the invention are particularly advantageous in that the material of which they are composed may be joined to itself or other materials, e.g. metals used as anodes and cathodes, or to cements used for example in cell construction, by the application of pressure and heat or by suitable inorganic or organic resin adhesives, for example epoxy, polyesters, polymethyl methacrylate and fluorinated thermoplastic polymers, for example fluorinated ethylene/propylene copolymers and PFA.

Other components may also be incorporated into the mat e.g. by inclusion in a spinning material and co-spinning with the PTFE, or by spinning separately, by post-treatment with a solution or suspension, or by being sprayed onto the mat as it is being spun. Such components include asbestos fibrils of appropriate dimensions and ion-exchange materials e.g. zeolites, zirconium phosphates etc., whereby the properties of the resulting product may be modified.

It is possible also to employ the products of the invention by subjecting them after formation to a comminution treatment whereby they are reduced to convenient dimensions for further processing, which may include admixture with, e.g. asbestos fibres or fibrils, zirconium oxide fibres etc. Said further processing could include formation by suitable shaping or forming techniques, including for example 'paper-making' or compression moulding technology, into desired shaped products. e.g. cell diaphragms.

The invention is illustrated by the following examples:

EXAMPLE 1

The apparatus employed was as shown in FIG. 1, the belt was of "Terylene" (RTM) net 20 cm wide.

The spinning liquid was prepared by mixing 80 parts w/w of an aqueous polytetrafluoroethylene dispersion having a PTFE solids loading of 60% and containing 2% (w/w on PTFE) of Triton X 100 surfactant (Rohm and Haas) with 20 parts w/w of a 10% solution of polyethylene oxide "Polyox" WSRN 3000 in water. The PTFE was of No. average mean particle size 0.22 micron and standard S.G. 2.190. The surfactant may be any of the range capable of stabilising PTFE of which Triton X 100 and "Triton DN65" are examples. The spinning liquid was spun from 20 × 1 ml syringes on to the net (the charge on the roller being 20 KV $^{-ve}$) situated 20 cm from the earthed needle tips.

The fibres were deposited over a width of about 16 cm and a sheet 0.4 mm thick was obtained. This sheet was then removed, placed on a stainless steel gauze support and sintered at 360° C for 5 minutes. A tough, porous,, white, slightly rough sheet of uniform thickness was produced, consisting of fibres of average diameter 2–3 microns apparently bonded together into a reticulum having 78% free volume.

EXAMPLE 2

A sheet obtained as described in Example 1 was treated as follows with (a) a 10% w/w aqueous solution of sodium hydroxide at 18° C for 24 hours, (b) 10% hydrochloric acid at 18° C for 24 hours, (c) a 10% w/w aqueous solution of sodium hydrogen phosphate at the boil for 1 hour, and finally with (d) a constantly agitated 10% w/w suspension of titanium dioxide (average particle size 0.2 micron) in isopropyl alcohol for 5 hours.

The PTFE sheet impregnated with the titanium dioxide was washed with isopropyl alcohol to remove excess solid and then mounted in a vertical diaphragm cell for the electrolysis of sodium chloride.

EXAMPLE 3

A diaphragm was prepared by electrostatic spinning from a mix containing an aqueous dispersion of PTFE of number average median particle size 0.22 microns (the Standard Specific Gravity of the polymer by ASTM test D 792-50 being 2.190) containing 3.6% by weight, based on the weight of the dispersion of surfactant "Triton"X 100 (Rohm and Haas) and having a PTFE solids content of 60% by weight to which has been added as a 10% by weight aqueous solution 2% (wt) of $4 \times 10^5$molecular weight poly(ethylene oxide) (Union Carbide, "(Polyox" grade WSRN 3000). The mix was fed at a rate of 1 ml/needle/h to a bank of 10 needles which was transversed parallel to the axis of a rotating drum collector/electrode over the entire length of the drum. The electrode potential was 20KV and the needle-electrode separation was 13cm. Approximately 40 mls of mix were spun before the sheet was removed from the drum and sintering by placing on a stainless steel gauze in an oven at 380° C for 20 mins. The porosity of the sheet (% free volume or pore volume) was determined from the mean thickness area and weight of the sheet and from the density of PTFE (2.13 g/cc). The mean thickness was 2.0 mm and the porosity was 76%.

The sheet was then soaked for 2 days in an aggitated 5% (wt) dispersion of $TiO_2$ (BTP 'Tioxide' RCR3) in iso-propyl alcohol (IPA). When mounted in a 120 $cm^2$ vertical test cell for the electrolysis of brine the diaphragm yielded a cell voltage of 7.50 V at a load of 1.67 $KAM^{-2}$ and at a permeability of 590 $h^{-1}$.

EXAMPLE 4

A sheet was spun as described in Example 1, except that every sixth syringe contained aqueous zirconium acetate (equivalent to 28% w/w zirconia) and 0.9% w/w of "Polyox" WSRN 3000. Collection and sintering were as described in Example 1 and a cream coloured porous sheet was obtained having good water wettability. SEM photographs showed the presence of 1 to 2 micron diameter "zirconia" fibres among those of PTFE.

EXAMPLE 5

A mixture of 20 parts (see Example 3) of zirconium acetate spinning solution and 80 parts of PTFE (see Example 1) was prepared and this spun as before. The product was cream in colour and had good water wettability.

EXAMPLE 6

To 99 parts w/w of the spinning solution used in Example 1 was added 1 part by weight of potassium chloride. After spinning as described in Example 1 (using a wider net) a sheet 30 cm wide was obtained which after treatment at 360° C for 5 minutes yielded a tough, white, very smooth sheet having fibre diameters in the range 0.5 to 1.5 microns and 60% free volume.

EXAMPLE 7

Samples of sheet produced by the process of Example 1 were pressed for a period of 3 minutes between metal plates ar varying pressures and temperatures with the following results:

| Pressure (psi) | Temp ° C | Porosity (% free volume) |
|---|---|---|
| 0 | 20 | 78 |
| 1,470 | 180 | 20 |
| 4,410 | 180 | 2 |
| 2,240 | 20 | 42 |
| 5,000 | 20 | 20 |
| 20,000 | 20 | 16 |

Relaxation of the sheets so obtained occurred gradually as follows.

| | Porosity (%) Free volume: | | |
|---|---|---|---|
| Initial | After pressing | After 24 hours | After 3 days |
| 78 | 42 | 52 | 56 |
| 77 | 54 | 57 | 70 |

Stabilisation of the compressed sheets was obtained by heating the sheets for 3 minutes at 380° C after pressing. The results were as follows:

| Initial porosity | After Pressing | After Heating | After 3 days |
|---|---|---|---|
| 75 | 44 | 61 | 61 |

EXAMPLE 8

Two samples were spun and sintered as described in Example 3 but throughout spinning $TiO_2$ powder was deposited via an air stream on to the collecting drum. The $TiO_2$ was controlled by the feed rate in the air stream. Both samples were pressed to approx 100 psi for 3 mins at 100° C and subsequently heat treated for 15 mins at 380° C. The sheets were mounted in test cells as described in example 3 from which the following results were obtained.

| Porosity | Thickness | $TiO_2$ content | Permeability | Voltage |
|---|---|---|---|---|
| 41% | 0.3 mm | 8% | 103 $h^{-1}$ | 3.45 |
| 50% | 0.55 mm | 35% | 58 $h^{-1}$ | 3.30 |

| Load | Time on Load | CE | CV |
|---|---|---|---|
| $2KAM^{-2}$ | 19 days | 78.2% | 76.8% |
| $2KAM^{-2}$ | 39 days | 80.3% | 59.2% |

CE is the % current efficiency as standardised for diaphragm cells for the electrolysis of brine. CV is the weight % measure of the amount of brine converted into useful product. Optimum values for this are around 50%.

EXAMPLE 9

Two samples were spun and sintered as described in example 3 but using a 6-needle bank. In the first case one of the six needles was fed with a zirconium acetate spinning solution and in the second case it was fed to two needles. Normal PTFE spinning liquid was supplied to the remaining needles. The zirconium acetate spinning solution contained an equivalent of 22% (wt) of zirconia ($ZrO_2$), 3% of $2 \times 10^5$ and 0.5% of $3 \times 10^5$ molecular weight poly(ethylene oxide). As a result of the dilute nature of the zirconium acetate spinning solutions and the approx 50% weight loss of these fibres on firing to zirconia, they were used only as an additional wetting agent and $TiO_2$ powder was blown into both sheets in the manner described in example 2.

The PTFE fibres were sintered and the zirconium acetate fibres were fired to an insoluble zirconia by treating for 30 mins at 380° C. Both samples were pressed to a load of 750 psi for 3 mins at 100° C followed by heat treatment at 380° C for 10 mins. The following results were obtained from the diaphragms when mounted in the test cells described in the previous examples.

| Porosity | Thickness | %$TiO_2$ (wt) | %$ZrO_2$* (Vol) | Volts |
|---|---|---|---|---|
| 56.8% | 0.5 mm | 26.4% | 5.9% | 4.75 |
| 46.0% | 0.6 mm | 40.0% | 2.7% | 3.50 |

| Load | Time on load | Permeability | CE | CV |
|---|---|---|---|---|
| $2KAM^{-2}$ | 3 days | 197 $h^{-1}$ | 97.4 | 22.2 |
| $2KAM^{-2}$ | 27 days | 83 $h^{-1}$ | 79.7 | 76.2 |

*This figure represents the volume of $ZrO_2$ fibres as a proportion of the total volume of the diaphragm.

EXAMPLE 10

A series of diaphragms was prepared from spinning liquids made up as described in example 3 but containing 4% (wt) of a $2 \times 10^5$ molecular weight poly(ethylene oxide) (Union Carbide "Polyox" WSRN 80) added as a 25% aqueous solution. Electrode voltage was 30 KV with a needle-electrode separation of 15 cm and mix feed-rates of 1.5–2.5 ml/needle/h. The needle-bank was traversed directly below the rotating drum electrode so that the fibres were spun upwards. Sheets were sintered on beds of fine $TiO_2$ powder to allow free movement of the sheets during the area shrinkage which accompanies sintering. By varying the volume of liquid spun, and by pressing to pre-set thicknesses, a range of diaphragms were produced with various thicknesses and porosities.

Characterised samples were first thoroughly wetted out by soaking for a minimum of 2 hours in isopropyl (IPA). Sheets were then treated by soaking for 30 mins in solutions of tetra-butyl titanate (TBT) in IPA. Finally, the sheets were immersed in water to hydrolyse the TBT causing precipitation of colloidal $TiO_2$ on the surfaces of the PTFE fibres. The results obtained from the test cells are given in the following Table 1.

TABLE 1

| POROSITY | THICKNESS | CONCENTRATION OF TBT SOLUTION (WT) | PERMEABILITY | VOLTS | LOAD | DAYS ON LOAD | CE | CV |
|---|---|---|---|---|---|---|---|---|
| 71% | 0.6 mm | 25% | $427h^{-1}$ | 3.16 | $2KAM^{-2}$ | 23 | 97.2% | 35.6% |
| 51% | 0.5 mm | 15% | $86h^{-1}$ | 3.80 | $2KAM^{-2}$ | 17 | 89.0% | 42.7% |
| 43% | 0.7 mm | 15% | $81h^{-1}$ | 3.40 | $2KAM^{-2}$ | 19 | 92.8% | 49.7% |
| 75% | 0.6 mm | 10% | $209h^{-1}$ | 3.12 | $2KAM^{-2}$ | 12 | 95.0% | 40.9% |
| 44% | 0.46 mm | 5% | $179h^{-1}$ | 3.30 | $2KAM^{-2}$ | 6 | 88.8% | 42.6% |
| 52% | 0.5 mm | 5% | $97h^{-1}$ | 3.55 | $2KAM^{-2}$ | 5 | 91.8% | 43.9% |
| 60% | 0.5 mm | 5% | $416h^{-1}$ | 3.30 | $2KAM^{-2}$ | 7 | 91.5% | 44.6% |
| 82% | 1.05 mm | 5% | $411h^{-1}$ | 3.50 | $2KAM^{-2}$ | 47 | 97.7% | 41.4% |

TABLE 2

| "POLYOX" Mn | "POLYOX" CONCENTRATION (WT) | % $TiO_2$ (WT) | POROSITY | THICKNESS | PERMEABILITY | VOLTS | DAYS ON LOAD | %CE | %CV |
|---|---|---|---|---|---|---|---|---|---|
| $2 \times 10^5$ | 4% | 10% | 68.0% | 0.80 mm | $154h^{-1}$ | 5.05 | 2 | 87.9 | 47.5 |
| $2 \times 10^5$ | 5% | 30% | 69.0% | 0.50 mm | $359h^{-1}$ | 3.65 | 3 | 92.7 | 45.9 |
| $4 \times 10^5$ | 2.5% | 40% | 53.0% | 0.48 mm | $280h^{-1}$ | 3.35 | 9 | 83.6 | 53.5 |
| $4 \times 10^5$ | 3.5% | 50% | 64.0% | 0.40 mm | $897h^{-1}$ | 3.20 | 21 | 92.1 | 40.4 |
| $4 \times 10^5$ | 3.0% | 50% | 83.7% | 0.87 mm | $687h^{-1}$ | 3.30 | 63 | 94.3 | 43.3 |
| $4 \times 10^5$ | 3.5% | 60% | 87.4% | 0.97 mm | $417h^{-1}$ | 3.25 | 34 | 86.7 | 40.9 |

EXAMPLE 11

Using the techniques described in example 10, diaphragm samples with various porosities and thicknesses were prepared. However, in these samples a range of $TiO_2$ loadings were incorporated into the fibres by spinning from co-dispersions of PTFE and $TiO_2$. 60% (wt) $TiO_2$ dispersions were prepared by high-speed mixing the $TiO_2$ powder (BTP "Tioxide" RCR2) in water containing 0.4% of $TiO_2$ weight of "Calgon S" (Albright and Wilson defloculating agent). Dispersed particle diameters were 0.4 - 0.5 μm. This dispersion was then added in appropriate amounts to the PTFE dispersion used in the previous examples. The required quantity of poly(ethylene oxide) solution was then blended into the co-dispersion and the resulting spinning liquid was degased and filtered. We have found that higher concentrations and greater molecular weights of poly(ethylene oxide) are required in these co-dispersions are compared with normal pure PTFE spinning liquid. In the results tabulated in the following Table 2 the concentrations and molecular weights quoted gave best spinning properties and fibres in the diameter range 0:8 - 1.8 μm.

The results for each diaphragm are given and were obtained from the test cells described in earlier examples. In each case the Load (current density) was $2KAM^{-2}$.

EXAMPLE 12

A PTFE porous sheet was prepared by the method described in example 4, but was subjected to high energy radiation in the presence of acrylic acid which affected the grafting of poly (acrylic acid) to the PTFE fibre surfaces.

The treated samples showed a 5% weight increase over the original sheet. When mounted in a standard test cell, the diaphragm exhibited the following characteristics:

| Porosity | Thickness | Permeability | Volts | Load |
|---|---|---|---|---|
| 51% | 0.8 mm | $57\ h^{-1}$ | 3.50 | $2KAM^{-2}$ |

| Days on Load | CE | CV |
|---|---|---|
| 34 | 93.3% | 53.4% |

What we claim is:

1. A method of preparing a porous polytetrafluoroethylene fibrous sheet suitable for use as a diaphragm is an electrochemical cell which comprises the step of introducing a spinning liquid comprising a dispersion of a polytetrafluoroethylene material and an additional polymeric component which acts to enhance the viscosity of the spinning liquid and serves to improve its fibre-forming properties into an electric field whereby fibres are drawn from the liquid to an electrode and collecting the fibres so produced upon the electrode in the form of a sheet.

2. A method according to claim 1 in which the fibres are 0.1 to 25 microns in diameter.

3. A method according to claim 2 in which the spinning liquid has a viscosity between 0.1 and 150 poise.

4. A method according to claim 3 in which the additional polymeric component is selected from the group consisting of polyethylene oxide, polyvinyl alcohol and polyvinyl pyrrolidone.

5. A method according to claim 3 in which the additional polymeric component is present in the spinning liquid at a concentration within the range 0.2 to 6% by weight.

6. A method according to claim 5 in which the spinning liquid has an electrical conductivity within the range $1 \times 10^{-6}\ 5 \times 10^{-2}$ siemens $cm^{-1}$.

7. A method according to claim 6 in which a wettable additive is incorporated in the sheet.

8. A method according to claim 7 in which the additive is an oxide or hydroxide of zirconium, titanium, chromium, magnesium or calcium.

9. A method according to claim 7, in which the additive is included, either as the additive or as a precursor thereof, in the spinning liquid.

10. A method according to claim 7 in which the additive is incorporated into the sheet after formation of the sheet.

11. A method according to claim 10 in which the additive is incorporated in the sheet by steeping the product in a suspension or solution containing the wettable additive or a precursor thereof.

12. A method according to claim 10 in which the product is sintered after its formation.

13. A electrochemical cell diaphragm obtained by the method of claim 2.

14. A diaphragm according to claim 13 which comprises a wettable additive.

15. A diaphragm according to claim 14 in which the wettable additive is an oxide or hydroxide of zirconium, titanium, chromium, magnesium or calcium.

16. A diaphragm according to claim 15 in which the concentration of wettable additive in the sheet is within the range 5 to 60% by weight.

17. An electrochemical cell fitted with an anode and a cathode and having interposed between the anode and the cathode, a diaphragm comprising a porous polytetrafluoroethylene fibrous sheet obtained by the method of claim 2.

* * * * *

UNITED STATES PATENT OFFICE

CERTIFICATE OF CORRECTION

Patent No. 4,127,706 Dated Nov. 28, 1978

Inventor(s) Graham E. Martin; Ian D. Cockshott; and Kevin T. McAloon

It is certified that error appears in the above-identified patent and that said Letters Patent are hereby corrected as shown below:

IN THE HEADING:

Please delete the section:

" [30] Foreign Application Priority Data
Sep. 26, 1974 [GB] United Kingdom.....41873/74 ".

Signed and Sealed this

Tenth Day of July 1979

[SEAL]

Attest:

Attesting Officer

LUTRELLE F. PARKER
Acting Commissioner of Patents and Trademarks